US010377451B2

(12) United States Patent
Johnson

(10) Patent No.: US 10,377,451 B2
(45) Date of Patent: Aug. 13, 2019

(54) CANOE AND PLATFORM COMBINATION ASSEMBLY

(71) Applicant: Robert D. Johnson, Saint Peter, MN (US)

(72) Inventor: Robert D. Johnson, Saint Peter, MN (US)

( * ) Notice: Subject to any disclaimer, the term of this patent is extended or adjusted under 35 U.S.C. 154(b) by 0 days.

(21) Appl. No.: 15/708,217

(22) Filed: Sep. 19, 2017

(65) Prior Publication Data

US 2019/0084656 A1 Mar. 21, 2019

(51) Int. Cl.
*B63B 1/12* (2006.01)
*B63B 35/71* (2006.01)

(52) U.S. Cl.
CPC ..... *B63B 35/71* (2013.01); *B63B 1/121* (2013.01); *B63B 2035/715* (2013.01)

(58) Field of Classification Search
CPC ... B63B 35/71; B63B 2035/715; B63B 35/38; B63B 2003/085; B63B 35/83; B63B 2001/123
See application file for complete search history.

(56) References Cited

U.S. PATENT DOCUMENTS

| | | | | |
|---|---|---|---|---|
| 2,712,293 | A * | 7/1955 | O'Higgins | B63B 1/121 114/354 |
| 3,473,502 | A * | 10/1969 | Wittkamp | B63B 1/121 114/345 |
| 3,613,136 | A | 10/1971 | Cogliano | |
| 5,657,713 | A * | 8/1997 | Rowlett | B63B 1/121 114/347 |
| 6,397,769 | B1 | 6/2002 | Bullmer | |
| 6,508,194 | B2 * | 1/2003 | Myers | B63B 1/121 114/354 |
| 6,595,813 | B1 * | 7/2003 | Lekhtman | B63H 16/12 440/21 |
| 7,281,487 | B1 | 10/2007 | Placek | |
| 8,820,255 | B1 | 9/2014 | Poppell et al. | |
| 9,156,526 | B2 | 10/2015 | Handley | |
| 9,611,008 | B1 | 4/2017 | O'Neal | |
| 2008/0047476 | A1 | 2/2008 | Stevenson | |

* cited by examiner

*Primary Examiner* — Andrew Polay

(57) ABSTRACT

A canoe and platform combination assembly includes a platform that has a top side, a bottom side, a front edge, a rear edge, a first lateral edge and a second lateral edge. A plurality of arms is attached to the platform. The arms engage canoes positioned adjacent to the first and second lateral sides such that the canoes are orientated parallel to each other. A plurality of tethers is provided. Each of the arms has one of the tethers positioned thereon. Each of the tethers is positioned around one of a plurality of braces of the canoes.

18 Claims, 5 Drawing Sheets

CANOE AND PLATFORM COMBINATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98.

The disclosure and prior art relates to canoe connecting and stabilizing devices and more particularly pertains to a new canoe connecting and stabilizing device for allowing attachment together of a pair of canoes in catamaran type configuration.

BRIEF SUMMARY OF THE INVENTION

An embodiment of the disclosure meets the needs presented above by generally comprising a platform that has a top side, a bottom side, a front edge, a rear edge, a first lateral edge and a second lateral edge. The platform has a length from the rear edge to the front edge that is between 5.0 feet and 9.0 feet and a width from the first lateral edge to the second lateral edge between 2.5 feet and 5.0 feet. A plurality of arms is attached to the platform. The arms are configured to engage canoes positioned adjacent to the first and second lateral sides such that the canoes are orientated parallel to each other. A plurality of tethers is provided. Each of the arms has one of the tethers positioned thereon. Each of the tethers is configured to be positioned around one of a plurality of braces of the canoes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
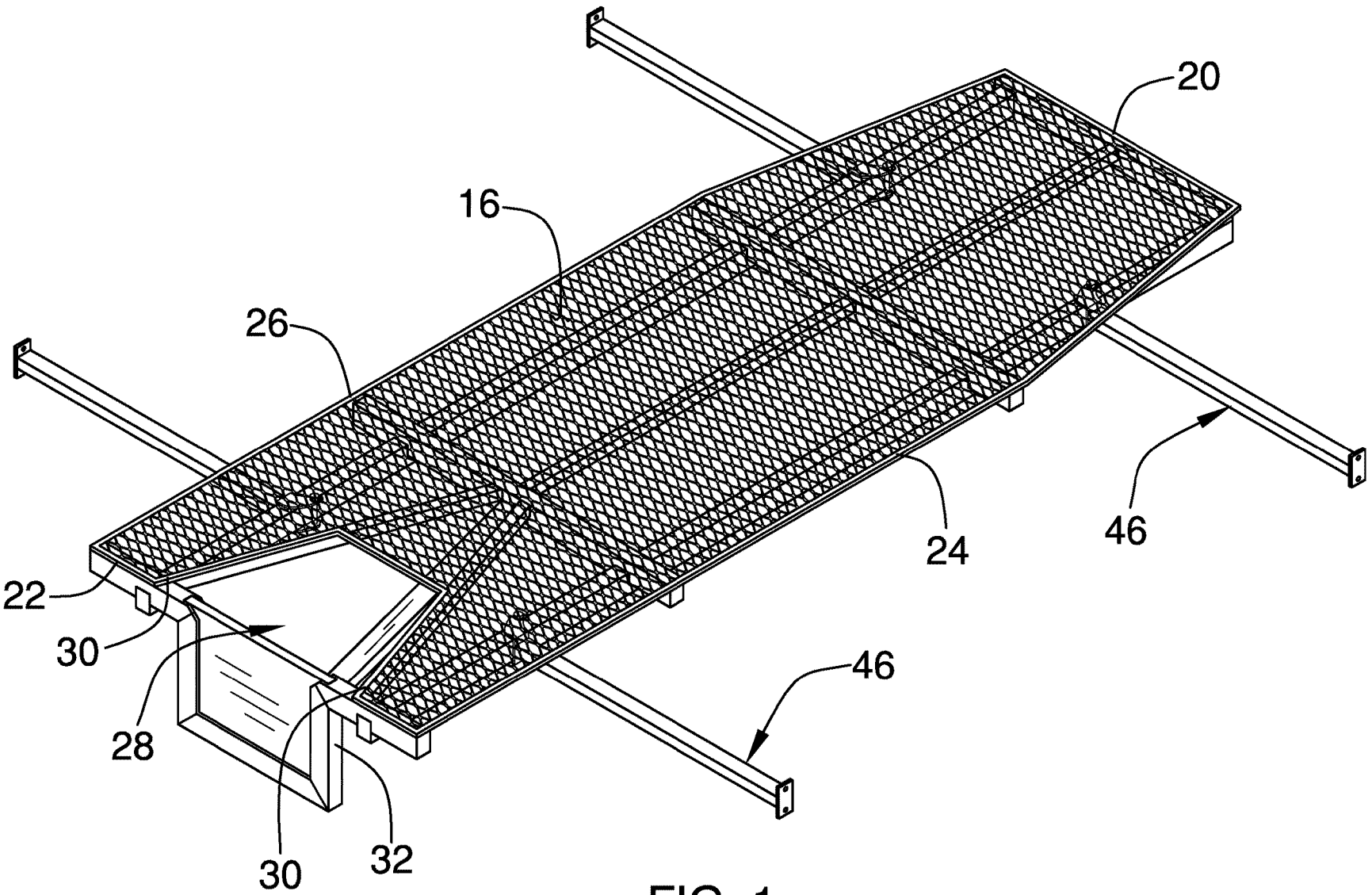
FIG. 1 is a top perspective view of a canoe and platform combination assembly according to an embodiment of the disclosure.
Figure 2:
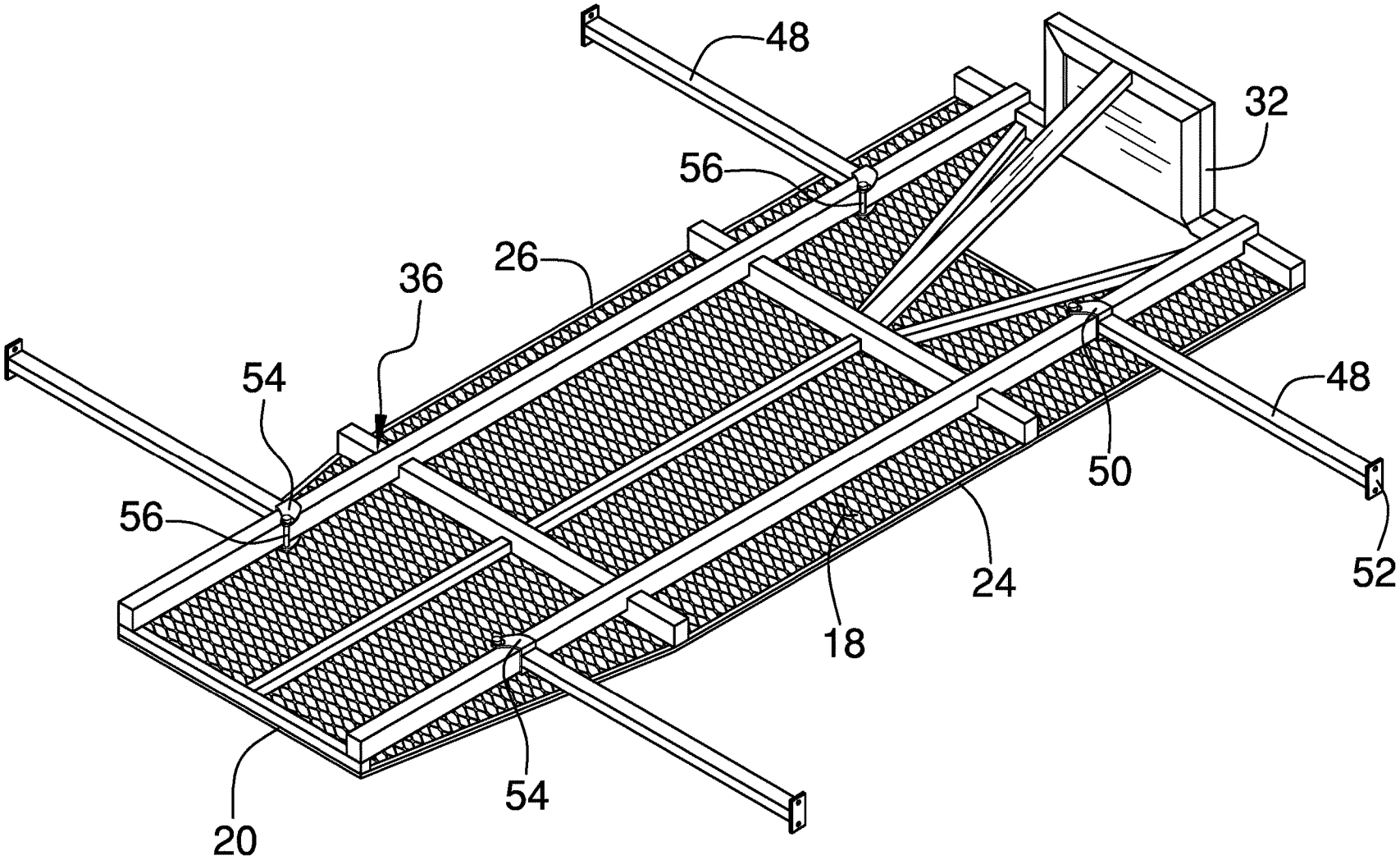
FIG. 2 is a bottom perspective view of an embodiment of the disclosure.
Figure 3:
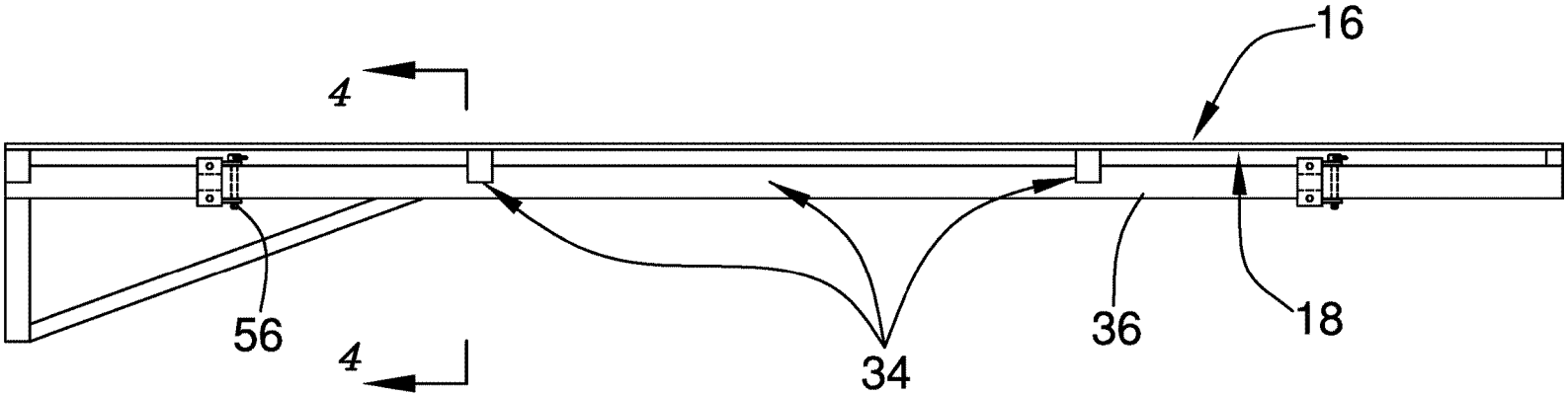
FIG. 3 is a side view of an embodiment of the disclosure.
Figure 4:
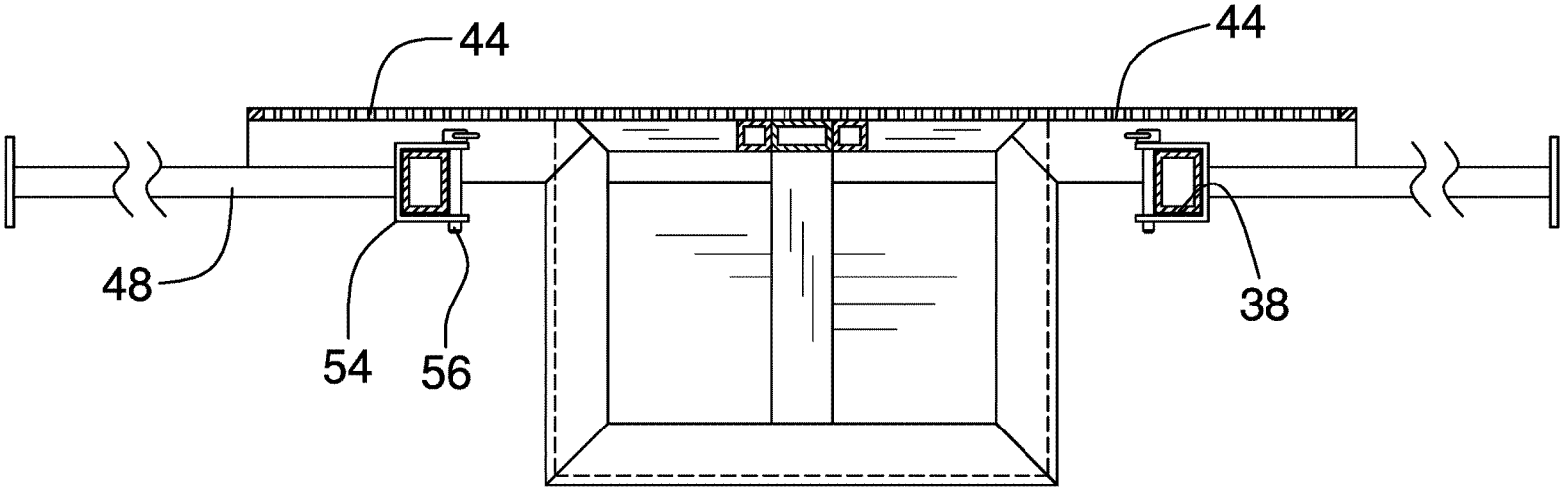
FIG. 4 is a cross-sectional view of an embodiment of the disclosure taken along line 4-4 of FIG. 3.
Figure 5:
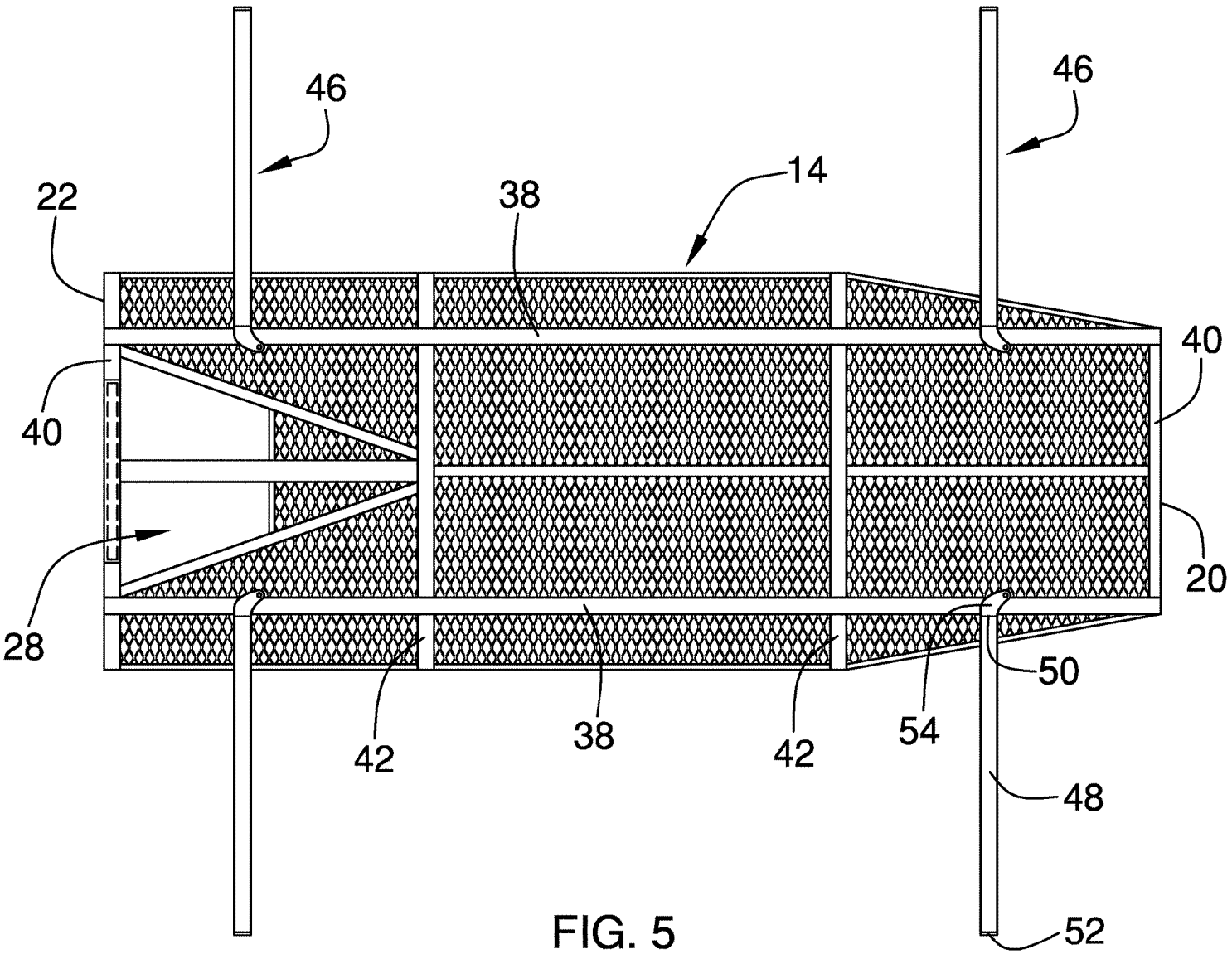
FIG. 5 is a bottom view of an embodiment of the disclosure.

With reference now to the drawings, and in particular to FIGS. 1 through 6 thereof, a new canoe connecting and stabilizing device embodying the principles and concepts of an embodiment of the disclosure and generally designated by the reference numeral 10 will be described.

As best illustrated in FIGS. 1 through 6, the canoe and platform combination assembly 10 generally includes a device utilized to couple together a pair of canoes 12 such that the canoes 12 are orientated parallel to each other and spaced from each other. The canoes 12 are conventional and have a length typically between 6.0 feet and 12.0 feet.

A platform 14 is provided that has a top side 16, a bottom side 18, a front edge 20, a rear edge 22, a first lateral edge 24 and a second lateral edge 26. The platform 14 has a length from the rear edge 22 to the front edge 20 that is between 5.0 feet and 9.0 feet and a width from the first lateral edge 24 to the second lateral edge 26 that is between 2.5 feet and 5.0 feet. The rear edge 22 has a notch 28 extending therein and the rear edge 22 has a pair of opposite edges 30. A transom 32 extends across and is attached to the opposite edges 30. The transom 32 may be utilized for the mounting of a motor, such as an electric motor, to be attached to the platform 14. The transom 32 may extend downwardly from the platform 14 to stabilize the motor.

The platform 14 comprises a plurality of support bars 34 that are attached together to define a framework 36. In particular, the support bars 34 may include a pair of lateral support bars 38 that extend from the front edge 20 to the rear edge 22 and a pair of end support bars 40 extending between and being attached to the lateral support bars 38. Additional intermediate support bars 42 may extend from the first lateral edge 24 to the second lateral edge 26 and are also attached to the lateral support bars 38. The framework 36 extends from the front edge 20 to the rear edge 22 and from the first lateral edge 24 to the second lateral edge 36.

A panel 44 is positioned on an upper side of the framework 36 and covers the framework 36. The panel 44 may comprise a metallic screen as is shown in the Figures though a solid panel may be utilized instead. Though not shown in the Figures, the framework 36 and the panel 44 may be provided in a pair of sections hingedly coupled together to allow the platform 14 to be folded in half for storage and transportation purposes.

Figure 6:
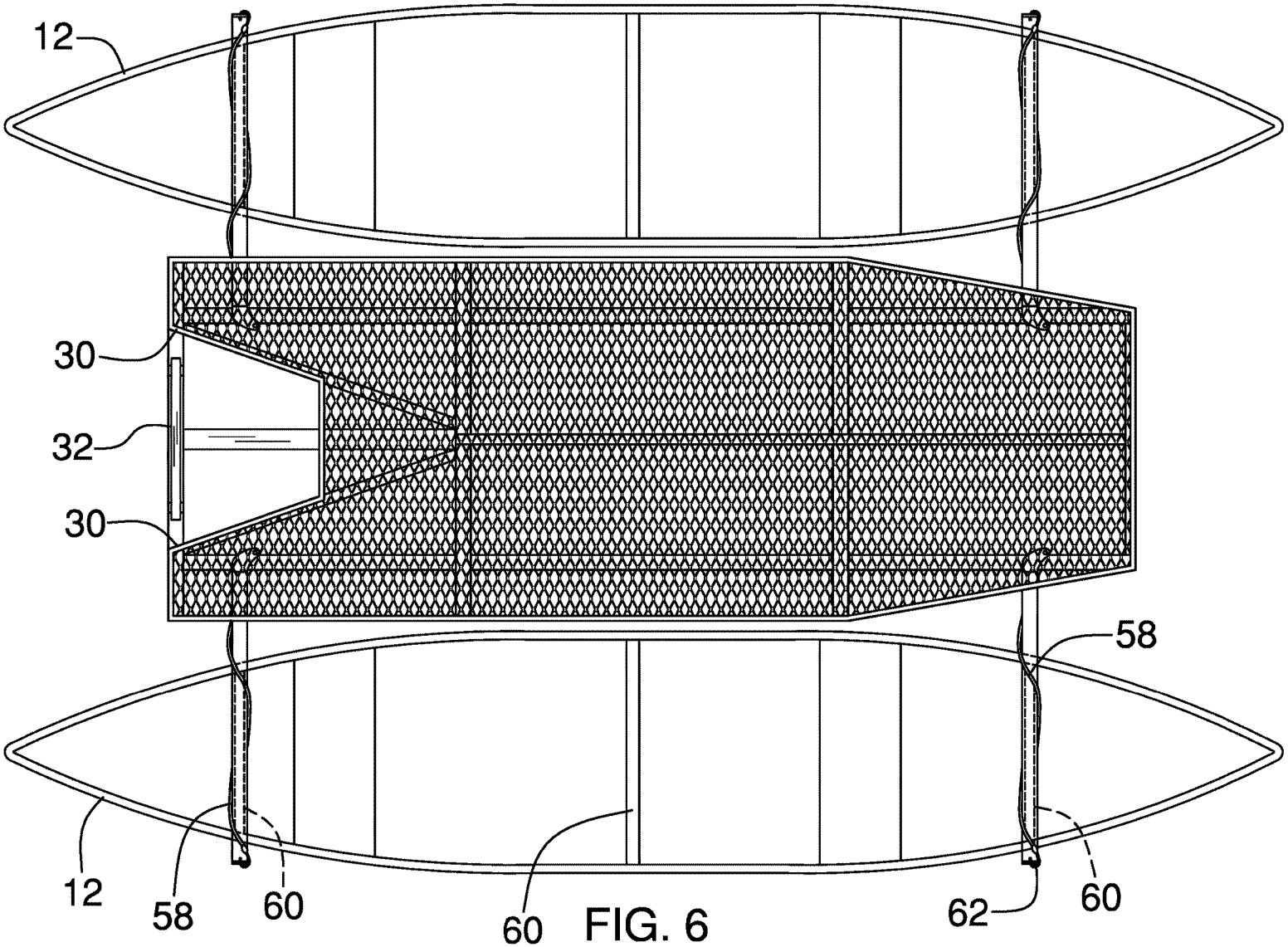
FIG. 6 is a top in-use view of an embodiment of the disclosure.

A plurality of arms 46 is attached to the platform 14. The arms 46 are configured to be positioned over engage canoes positioned adjacent to the first 24 and second 26 lateral sides such that the canoes 12 are orientated parallel to each other as is shown in FIG. 6. The plurality of arms 46 will typically include four arms 46.

Each of the arms 46 includes an elongated rod 48 each having an inner end 50 and an outer end 52. The rods 48 may be telescopic to facilitate canoes having different widths. A collar 54 is attached to the inner end 50. The collar 54 is mounted to the framework 36 such that the arm 46 is in an extended positioning extending from the platform 14 and is orientated perpendicular to the platform 14. The collar 54 allows the outer end 52 to pivot from the extended position forward toward the front edge 20. Thus, when the canoes 12 are moving forward, the arms 46 will be retained in a perpendicular orientation with respect to the lateral support bars 38 to which they are attached but may be folded up against the lateral support bars 38 when not in use. A removable pin 56 extends through the collar 54 and releasably retains the collar 54 in engagement with the framework 36 of the platform 14. The removable pin 56 may be released from the collar 54 to remove the arm 46 completely from the platform 14.

A plurality of tethers 58 is provided. Each of the arms 46 has one of the tethers 58 positioned thereon and each of the tethers 58 is configured to be positioned around one of a plurality of braces 60 of the canoes 12. Each canoe 12 will typically have two or three braces 60 that are positioned adjacent to an upper edge of the canoes 12. The tethers 58 secure the arms 46 to the braces 60 by wrapping the tethers 58 around associated ones of the arms 46 and braces 60. The tethers 58 may each be resiliently stretchable and include ends comprising hooks 62 to engage the platform 14 and the outer ends 52.

In use, the platform 14 is positioned between and attached to the canoes 12 as described above and as shown in the Figures. The platform 14 is stabilized by the canoes 12 over water and acts as a storage location for placement of articles such as backpacks, coolers, chairs and the like. The arms 46 are foldable when not in use to allow the platform 14 to be more easily carried and transported along hiking trails.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A canoe engagement assembly configured to couple two canoes together, said system comprising:

a platform having a top side, a bottom side, a front edge, a rear edge, a first lateral edge and a second lateral edge, said platform having a length from said rear edge to said front edge being between 5.0 feet and 9.0 feet and a width from said first lateral edge to said second lateral edge between 2.5 feet and 5.0 feet;

a plurality of arms being attached to said platform, each of said arms being configured to engage a respective one of the two canoes when the two canoes are positioned adjacent to said first and second lateral sides such that said canoes are orientated parallel to each other whereby each one of the arms is coupled to the respective one of the two canoes, each of said arms includes:

an elongated rod having an inner end and an outer end, and a collar being attached to said inner end, said collar being mounted to a framework such that said arm is in an extended positioning extending from said platform and being orientated perpendicular to said platform; and a plurality of tethers, each of said arms having one of said tethers positioned thereon, each of said tethers being configured to be positioned around one of a plurality of braces of the canoes.

2. The canoe engagement assembly according to claim 1, wherein said platform comprises:

a plurality of support bars being attached together to define a framework, said framework extending from said front edge to said rear edge and from said first lateral edge to said second lateral edge; and a panel being positioned on an upper side of said framework and covering said framework.

3. The canoe engagement assembly according to claim 2, wherein said panel comprises a metallic screen.

4. The canoe engagement assembly according to claim 1, wherein said collar allows said outer end to pivot from said extended position forward toward said front edge.

5. The canoe engagement assembly according to claim 4, further including a removable pin extending through said collar and releasably retaining said collar in engagement with said platform.

6. The canoe engagement assembly according to claim 1, further including a removable pin extending through said collar and releasably retaining said collar in engagement with said platform.

7. The canoe engagement assembly according to claim 1, wherein each of said tethers are resiliently stretchable.

8. The canoe engagement assembly according to claim 1, further including:

said rear edge having a notch extending therein, said rear edge having a pair of opposite edges; and a transom extending across and being attached opposite edges.

9. A canoe engagement assembly configured to couple two canoes together, said system comprising:

a platform having a top side, a bottom side, a front edge, a rear edge, a first lateral edge and a second lateral edge, said platform having a length from said rear edge to said front edge being between 5.0 feet and 9.0 feet and a width from said first lateral edge to said second lateral edge between 2.5 feet and 5.0 feet, said platform comprising;

a plurality of support bars being attached together to define a framework, said framework extending from said front edge to said rear edge and from said first lateral edge to said second lateral edge;

a panel being positioned on an upper side of said framework and covering said framework, said panel comprising a metallic screen;

a plurality of arms being attached to said platform, each of said arms being configured to engage a respective one of the two canoes when the two canoes are positioned adjacent to said first and second lateral sides such that said canoes are orientated parallel to each other whereby each one of the arms is coupled to the respective one of the two canoes, said plurality of arms being four arms, each of said arms including:

an elongated rod having an inner end and an outer end;

a collar being attached to said inner end, said collar being mounted to said framework such that said arm is in an extended positioning extending from said platform and being orientated perpendicular to said platform, said collar allowing said outer end to pivot from said extended position forward toward said front edge;

a removable pin extending through said collar and releasably retaining said collar in engagement with said platform;

a plurality of tethers, each of said arms having one of said tethers positioned thereon, each of said tethers being configured to be positioned around one of a plurality of braces of the canoes, said tethers each being resiliently stretchable;

said rear edge having a notch extending therein, said rear edge having a pair of opposite edges; and a transom extending across and being attached to said opposite edges.

10. A canoe engagement system comprising:

a pair of canoes;

a platform having a top side, a bottom side, a front edge, a rear edge, a first lateral edge and a second lateral edge, said platform having a length from said rear edge to said front edge being between 5.0 feet and 9.0 feet and a width from said first lateral edge to said second lateral edge between 2.5 feet and 5.0 feet;

a plurality of arms being attached to said platform, said arms being extending over said canoes such that said platform is positioned between said canoes, said canoes being positioned adjacent to said first and second lateral sides such that said canoes are orientated parallel to each other, said plurality of arms being four arms; and a plurality of tethers, each of said arms having one of said tethers positioned thereon, each of said tethers being positioned around one of a plurality of braces of the canoes.

11. The canoe engagement system according to claim 10, wherein said platform comprises:

a plurality of support bars being attached together to define a framework, said framework extending from said front edge to said rear edge and from said first lateral edge to said second lateral edge; and a panel being positioned on an upper side of said framework and covering said framework.

12. The canoe engagement system according to claim 11, wherein said panel comprises a metallic screen.

13. The canoe engagement system according to claim 10, wherein each of said arms includes:

an elongated rod having an inner end and an outer end, said inner end being mounted to a framework such that said arm is in an extended positioning extending from said platform and being orientated perpendicular to said platform.

14. The canoe engagement system according to claim 13, wherein said said inner end is mounted to said framework such that said outer end is pivotable from said extended position forward toward said front edge.

15. The canoe engagement system according to claim 14, further including said inner end being mounted by a removable pin extending through a collar, said pin releasably retaining said collar in engagement with said framework.

16. The canoe engagement system according to claim 13, further including said inner end being mounted by a removable pin extending through a collar, said pin releasably retaining said collar in engagement with said framework.

17. The canoe engagement system according to claim 10, wherein each of said tethers are resiliently stretchable.

18. The canoe engagement system according to claim 10, further including:

said rear edge having a notch extending therein, said rear edge having a pair of opposite edges; and a transom extending across and being attached to said opposite edges.

* * * * *